US006988873B2

(12) United States Patent
Marioni

(10) Patent No.: US 6,988,873 B2
(45) Date of Patent: Jan. 24, 2006

(54) MONODIRECTIONAL IMPELLER WITH FLEXIBLE VANES

(75) Inventor: Elio Marioni, Dueville (IT)

(73) Assignee: Askoll Holding S.r.l., (IT)

( * ) Notice: Subject to any disclaimer, the term of this patent is extended or adjusted under 35 U.S.C. 154(b) by 0 days.

(21) Appl. No.: 10/731,555

(22) Filed: Dec. 9, 2003

(65) Prior Publication Data

US 2004/0136848 A1 Jul. 15, 2004

Related U.S. Application Data

(62) Division of application No. 10/069,268, filed as application No. PCT/IT01/00350 on Jul. 2, 2001, now Pat. No. 6,685,446.

(30) Foreign Application Priority Data

Jul. 6, 2000 (IT) ..... PD2000A0176
May 14, 2001 (IT) ..... PD2001A0110

(51) Int. Cl.
*F04D 29/28* (2006.01)

(52) U.S. Cl. ..... 416/132 R; 416/140; 416/240; 416/243; 416/170 R

(58) Field of Classification Search ..... 416/135, 416/129, 141, 175, 185, 203–4, 235, 132 R, 416/140, 240, 243, 170 R; 417/423.7, 319
See application file for complete search history.

(56) References Cited

U.S. PATENT DOCUMENTS

| | | | | |
|---|---|---|---|---|
| 4,008,985 | A | 2/1977 | Schemmann et al. | |
| 4,755,105 | A * | 7/1988 | Blakeslee et al. | 415/141 |
| 4,861,240 | A * | 8/1989 | Marioni et al. | 417/423.3 |
| 5,711,657 | A * | 1/1998 | Hoffmeier | 417/319 |
| 6,217,452 | B1 * | 4/2001 | Marioni | 464/74 |
| 6,384,508 | B1 * | 5/2002 | Marioni | 310/261 |

FOREIGN PATENT DOCUMENTS

| | | |
|---|---|---|
| DE | 33 22 933 A1 | 1/1985 |
| EP | 0 103 720 A1 | 3/1984 |

* cited by examiner

*Primary Examiner*—Ninh H. Nguyen
(74) *Attorney, Agent, or Firm*—Akerman Senterfitt

(57) ABSTRACT

A monodirectional impeller for centrifugal electric pumps having a permanent-magnet synchronous motor, having vanes which are deformable at least along part of their extension so as to change their curvature, when loaded, in one direction of rotation, so that the power required for rotation in that direction is greater than the maximum power that can be delivered by the motor.

13 Claims, 6 Drawing Sheets

MONODIRECTIONAL IMPELLER WITH FLEXIBLE VANES

BACKGROUND OF THE INVENTION

The present invention relates to a monodirectional impeller for centrifugal electric pumps having a permanent-magnet synchronous motor.

It is known that permanent-magnet synchronous electric motors have a general structure which comprises a stator, provided with an electromagnet constituted by a lamination pack and by corresponding windings, and a rotor, which is arranged between two pole shoes formed by the stator and is crossed axially by a shaft which is rotatably connected to a supporting structure.

These motors are bidirectional, i.e., at startup the rotor can be induced equally to turn clockwise or counterclockwise.

This characteristic depends on a plurality of factors, including the arrangement of the polarities of the rotor with respect to the magnetic field generated between the pole shoes of the stator pack when the induction windings are supplied with AC current.

For this reason, permanent-magnet synchronous motors are currently widely used where the direction of rotation is not important; accordingly, for example they are coupled, in centrifugal pumps, to radial-vane impellers which ensure the same performance in both directions of rotation.

In order to increase the efficiency of synchronous-motor electric pumps without resorting to the use of particular electronic starting devices, it is convenient to use vanes which are orientated with a certain curvature profile, which clearly presumes a single direction of rotation of the motor.

Accordingly, electronic starter devices have been devised which guide the motor so that it starts in a single direction of rotation; as an alternative thereto, mechanical devices have been devised which block the rotor when it tends to start in the wrong direction of rotation (reference should be made for example to patent application PD98A000003 of Jan. 8, 1998 in the name of this same Applicant).

In this manner, monodirectional behavior is ensured in any operating condition assumed by the electric pump.

However, the system may generate noise during starting and is a limitation as regards reliability (for high-power pumps), since there is a mechanical device which is subjected to repeated stresses, especially during starting.

A particularly important alternative for a monodirectional synchronous electric pump without mechanical devices for stopping the rotor and without electronic devices (which are reliable but expensive) is constituted by what is disclosed in patent application PD98A000058 of Mar. 19, 1998 in the name of this same Applicant.

This patent application discloses a device which is able to start, with limited power levels, loads which have high moments of inertia, such as impellers with orientated vanes of a centrifugal pump.

In particular, this is a driving device with a larger angle of free rotation between the rotor and the impeller, so as to obtain, with respect to conventional mechanical couplings, several advantages:

reduction of the starting torque for starting the motor;

a consequent reduction of the level of vibrations generated during synchronous operation;

the motor is rendered monodirectional by means of the correct design of the vanes of the impeller, so that the power absorbed by the load in one direction of rotation is greater than the available power of the motor and is smaller in the opposite direction of rotation.

Therefore, by designing the motor and the vanes of the impeller so that the power absorbed by the load in one direction of rotation is greater than the available power of the motor and smaller in the opposite direction of rotation, in the first case the impeller goes out of step with respect to the motor, is halted and automatically reverses its motion, whereas in the second case it is driven normally.

It is thus possible to render the pump monodirectional by utilizing the difference in power between what the motor is able to deliver and the power absorbed by the load in the two directions of rotation (the rotor stops because the power required by the impeller in the wrong direction of rotation is greater than the power that the motor can deliver).

Although this system provides a fundamental advantage with respect to the prior art, it still has limitations, because monodirectionality is ensured only within a flow-rate/head range; accordingly, it is used in applications where the hydraulic working point does not vary beyond certain limits or, in other words, where the characteristic curve of the duct does not undergo significant variations (this is the case, for example, of washing pumps for dishwashers).

In the accompanying drawings FIG. 1 plots, for both directions of rotation of the motor, the power absorbed by the motor as a function of the required flow-rate.

The line A plots the correct direction of rotation, the line B plots the wrong direction of rotation, and the straight line C represents the maximum power that can be delivered by the motor.

The chart shows three flow-rates Q1, Q2 and Q3, which correspond to three working points, and it is clear that only Q1 and Q2 are the flow-rates for which a single direction of rotation is ensured, since the maximum power that the motor is able to deliver (straight line C) is greater than the power required by the impeller when it turns in the correct direction of rotation (line A) and is smaller than the power required by the impeller when it turns in the opposite direction (line B).

For the flow-rate Q3, instead, there is a condition in which both power levels, in both directions of rotation, are lower than the maximum deliverable power and therefore monodirectional behavior is not possible.

SUMMARY OF THE INVENTION

The aim of the present invention is therefore to eliminate the above-noted drawbacks of the above-cited device related to patent application Within this aim, a consequent primary object is to provide a pump which is monodirectional over the entire available flow-rate range.

Another object is to provide all of the above in a constructively simple manner.

Another object is to have no effect on noise levels.

Another object is to provide an impeller, if necessary, with deformable vanes enclosed between a double fluid conveyance wall (closed impeller).

This aim and these and other objects which will become better apparent hereinafter are achieved by an impeller for centrifugal electric pumps having a permanent-magnet synchronous motor, characterized in that its vanes are deformable at least along part of their extension and can change their curvature, when loaded, in one direction of rotation, so that the power required for rotation in that direction is greater than the maximum power that can be delivered by the motor.

Conveniently, in one embodiment, this aim and these objects are achieved by an impeller for centrifugal electric pumps having a permanent-magnet synchronous motor, characterized in that it comprises:

a first disk-like element provided with curved nondeformable vanes which are monolithic therewith, an annular element, whose dimensions are contained within the inlet dimensions of said nondeformable vanes and which is provided with means for coupling to said first disk-like element, said annular element being provided with flexibly deformable vanes which cantilever outward, are interposed between the nondeformable ones, and are adapted to modify, when loaded, their curvature in one of the directions of rotation so that the power required for rotation in that direction is greater than the maximum power that can be delivered by the motor, a second disk-like element, which encloses, together with said first disk-like element, the set of vanes and is rigidly coupled to said nondeformable vanes, leaving the deformable ones free.

BRIEF DESCRIPTION OF THE DRAWINGS

Further characteristics and advantages of the invention will become better apparent from the detailed description of embodiments thereof, illustrated only by way of non-limitative example in the accompanying drawings, wherein.

DESCRIPTION OF THE PREFERRED EMBODIMENTS

Figure 1:
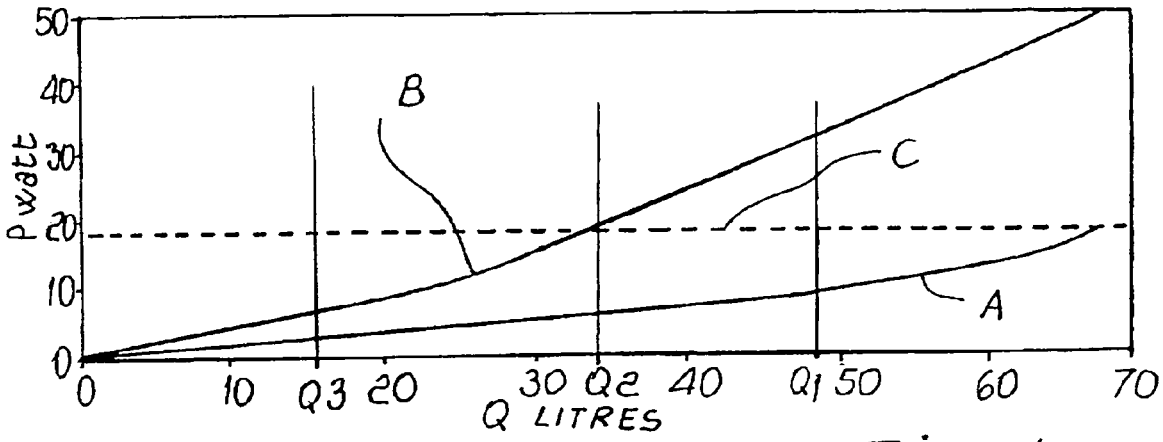
FIG. 1 is a chart which plots, for conventional centrifugal pumps, the flow-rate as a function of the power required in the two directions of rotation.
Figure 2:
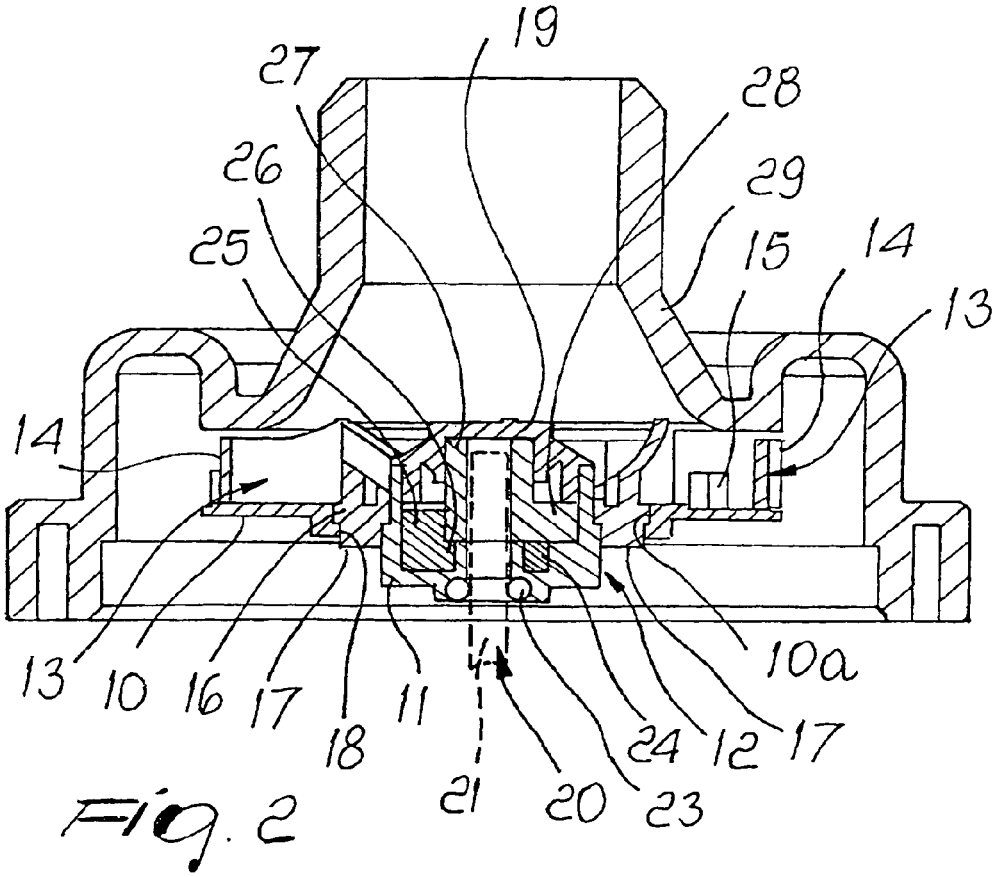
FIG. 2 is a sectional view of an impeller according to the invention in a first embodiment, arranged inside a volute of a centrifugal pump.
Figure 3:
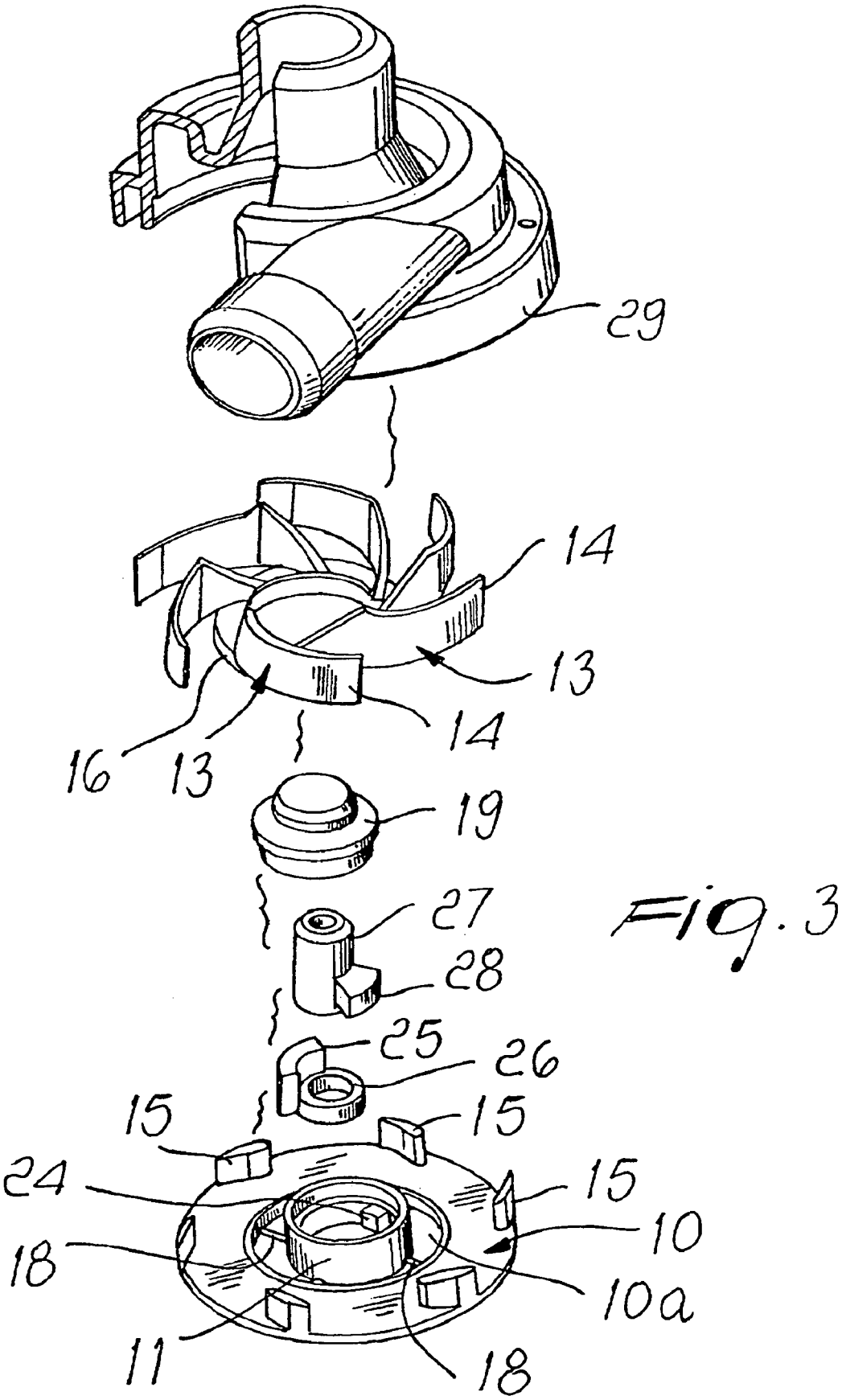
FIG. 3 is an exploded view of the components of FIG. 2.

With reference to FIGS. 2 and 3, in a first embodiment the impeller according to the invention comprises a disk 10 with a central hollow cup-shaped body 11 which is a component of a driving device 12 described in greater detail hereinafter.

A plurality of vanes 13 protrudes from a ring 16 which is located on the outside of the cup-shaped body 11 in a corresponding seat 10*a* of the disk 10.

The vanes 13 are monolithic with respect to the ring 16, which affects only their part that lies closest to the center.

The peripheral part can therefore perform flexing movements arising from the elastic characteristics of the material of which they are made.

The vanes 13 can also be rigidly coupled to the ring 16 (axial and torsional retention) in various manners: by interlocking and/or interference, ultrasonic welding, adhesive bonding.

The peripheral regions 14 of the vanes 13 are therefore flexibly deformable, as mentioned, and said deformation is greater for the wrong direction of rotation and is optionally limited by the stroke limiting teeth 15 which protrude from the disk 10 alternately with the vanes 13.

In order to center the vanes 13 with respect to the teeth 15, the ring 16 has axial teeth 17 to be inserted in appropriately provided holes 18 of the disk 10.

As regards the driving device 12, it comprises said hollow body 11 and a cover 19 which can also be rigidly coupled to the ring 16 with the vanes 13.

The hollow body 11 is provided with an axial hole 20 for the shaft 21 of the rotor, not shown in the figures, of the motor.

An O-ring gasket 23 acts on the shaft 21 and is accommodated in a corresponding seat of the hollow body 11.

The hermetic seal of the device 12 is ensured not only by the gasket 23 but also by the closure of the lid 19, which is provided by ultrasonic welding, adhesive bonding or other known methods on the hollow body 11.

It is possible to provide alternative embodiments which are not hermetic or in which the lid 19 is monolithic with the ring 16.

In said ring, a tooth 24 protrudes from the inner wall and is therefore rigidly coupled to the impeller assembly; said tooth 24 interacts with a tooth 25 which protrudes from a ring 26 which can rotate about a shank 27 which is mounted with interference on the shaft 21 and is rigidly coupled thereto.

A tooth 28 protrudes radially from the shank 27 and interacts, in its rotation, with the tooth 25 of the ring 26, whose axial extension is such as to affect the path of the rotation of both teeth 24 and 25.

Said teeth are arranged axially so that they do not interfere with each other.

Accordingly, the rotation of the shaft 21 starts the rotation of the tooth 28, makes said tooth interact with the tooth 25, turning it until it interferes with the tooth 24, and finally makes the rotor turn the impeller.

Grease, with a shock-absorbing function, can be conveniently placed inside the hollow body 11.

FIGS. 2 and 3 also illustrate the volute 29 in which the impeller is arranged.

Figure 4:
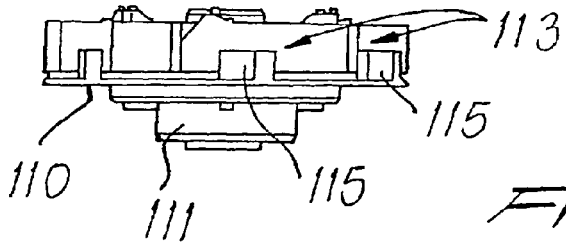
FIG. 4 is a plan view of an impeller according to the invention in a second embodiment.
Figure 5:
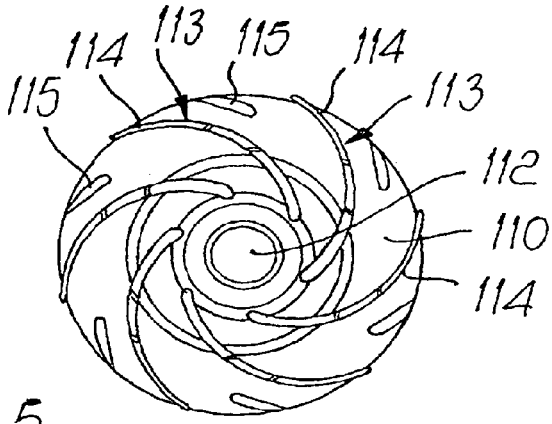
FIG. 5 is a side view of the impeller of FIG. 4.

With reference now to FIGS. 4 and 5, an impeller according to the invention, in a second embodiment which is simplified with respect to the preceding one, comprises a disk 110, from which a coaxial shank 111 with a hole 112 for the shaft of the rotor (not shown for the sake of simplicity) protrudes centrally on one side, and from which a plurality of vanes 113 with a curved profile protrudes on the other side.

The impeller as a whole is formed monolithically.

According to the invention, the vanes 113 are flexibly deformable along at least part of their extension, so as to modify their curvature, when loaded, in one of the two directions of rotation so that the power required for rotation in that direction is greater than the maximum power that can be delivered by the motor.

The deformability of the vanes arises from the flexibility of their peripheral regions 114, which are provided separately from the disk 110 by the molding step by way of an appropriate shaping of the mold.

By providing the impeller as a single part made of plastics, with the peripheral regions 114 divided from the rest, said regions flex, when loaded, in the wrong direction of rotation and modify their curvature so that in practice they block the rotation.

Conveniently, teeth 115 protrude from the disk 110 in the peripheral region, are alternated with the vanes 113, and advantageously act as stop elements which avoid excessive curvatures of said vanes 113 in the wrong direction of rotation, thus avoiding excessive stresses thereto.

The flexibility of the material would of course allow flexing in the correct direction of rotation as well, but the curvature of the vanes 113, which matches the fluid threads that form during the rotation of the impeller, causes deformation in the correct direction of rotation to be very limited in practice.

Figure 6:
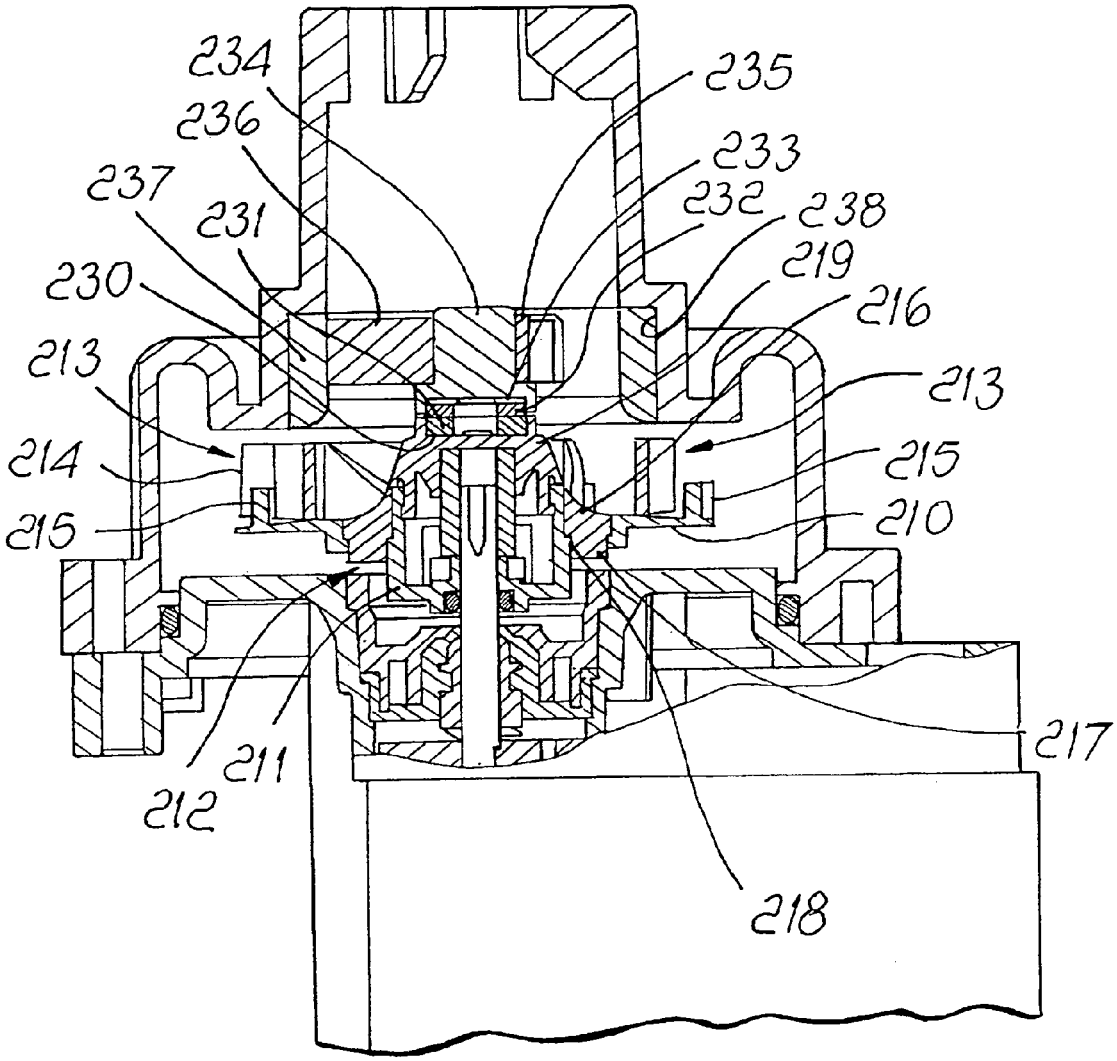
FIG. 6 is a sectional view of an impeller according to the invention in a third embodiment, arranged inside a volute of a centrifugal pump.

With reference to FIG. 6, in a third embodiment the impeller according to the invention comprises a disk 210 with a cup-shaped central hollow body 211 which is a component of a driving device 212 similar to the one of the first embodiment.

A plurality of vanes 213 protrudes from a ring 216 which is arranged on the outside of the cup-shaped body 211 in a corresponding seat 210*a* of the disk 210.

The vanes 213 are monolithic with respect to the ring 216, which affects only the part of said vanes that lies closest to the center.

The peripheral part can therefore perform flexing movements arising from the characteristics of the material of which the vanes are made.

The vanes 213 can also be rigidly coupled to the ring 216 (axial and torsional retention) in various manners: by interlocking and/or interference, ultrasonic welding, adhesive bonding.

The peripheral regions 214 of the vanes 213 are therefore, as mentioned, flexibly deformable, and said deformation is greater for the wrong direction of rotation and is limited by teeth 215 which protrude from the disk 210 alternately with the vanes 213.

In order to center the vanes 213 with respect to the teeth 214, the ring 216 has axial teeth 217 to be inserted in appropriately provided holes 218 of the disk 210.

Also in this case, the cover 219 is separate from the ring 216, but it is also possible to provide alternative embodiments in which the cover 219 is monolithic with the ring 216.

In this embodiment, the lid 219 of the hollow body 211 has, at its end, a seat 230 for a first shim ring 231 made of ceramic material, sintered material or similar hard material.

A second shim ring 232 made of ceramic material, sintered material or similar hard material is accommodated in a seat 233 provided at the end of a cylindrical support 234 which is supported by a bush 235 which is rigidly coupled, by means of radial spokes 236, to a ring 237 which is inserted with interference in a corresponding seat 238 of the volute 229.

As an alternative, the support 234 can be monolithic with the bush 235.

The ring 232 acts as an axial thrust bearing in order to adjust, in cooperation with the ring 231, the position that the impeller assumes in the volute 229 and maximize hydraulic efficiency.

Figure 7:
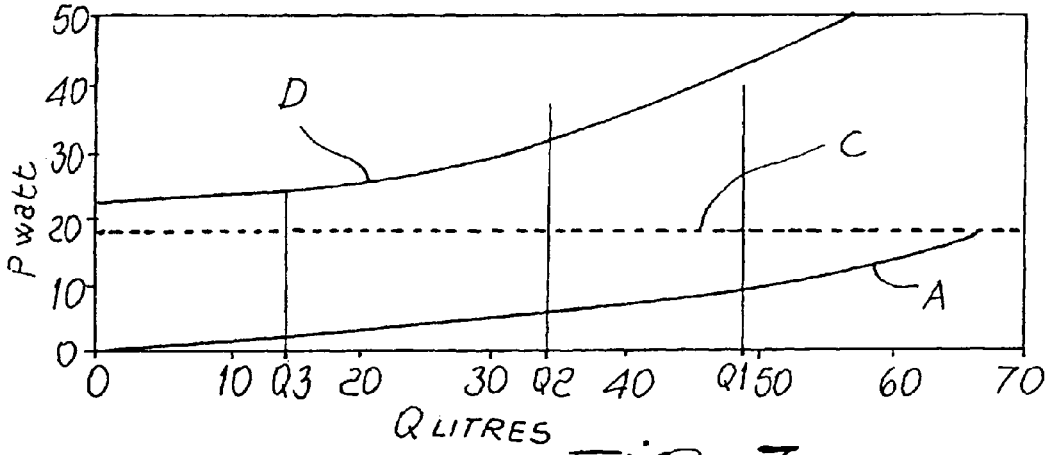
FIG. 7 is a chart which plots, for centrifugal pumps with impellers according to the invention, the flow-rate as a function of the power required in the two directions of rotation.

With reference now to FIG. 7, said figure is a chart which plots the flow-rate as a function of power and wherein:

the line D is the curve related to an impeller with the flexible vanes according to the invention, with the wrong direction of rotation;

the line C represents the maximum power that the motor can deliver;

the line A plots the curve related to an impeller with flexible vanes, in the correct direction of rotation.

The line D clearly shows that for any flow-rate in the wrong direction of rotation, the flexible vane requires more power than the motor can generate (straight line C).

Accordingly, the motor cannot start in the wrong direction.

Figure 8:
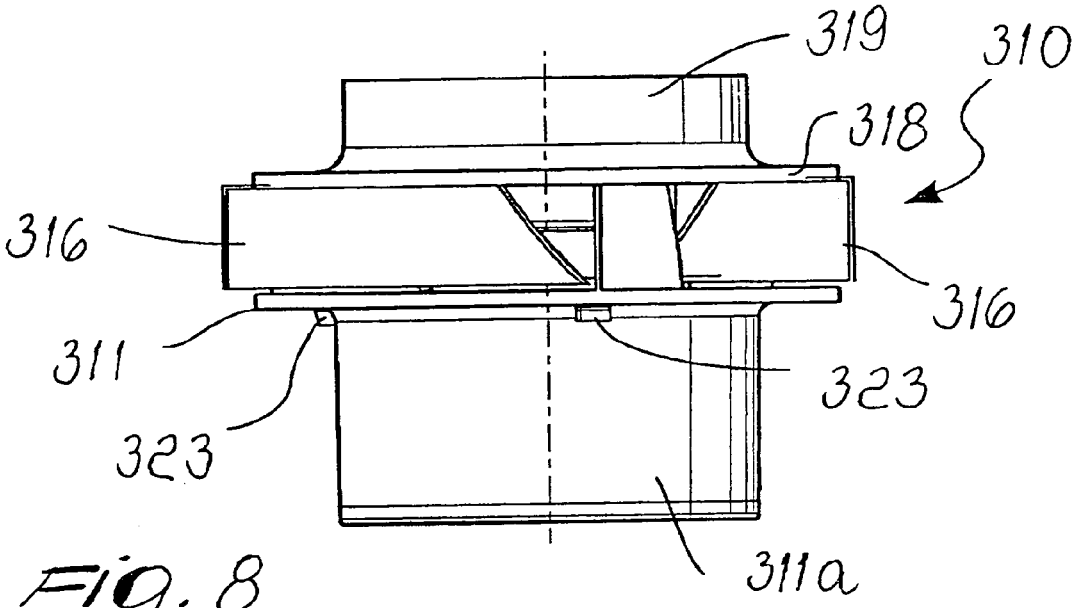
FIG. 8 is a side view of another impeller according to the invention.
Figure 9:
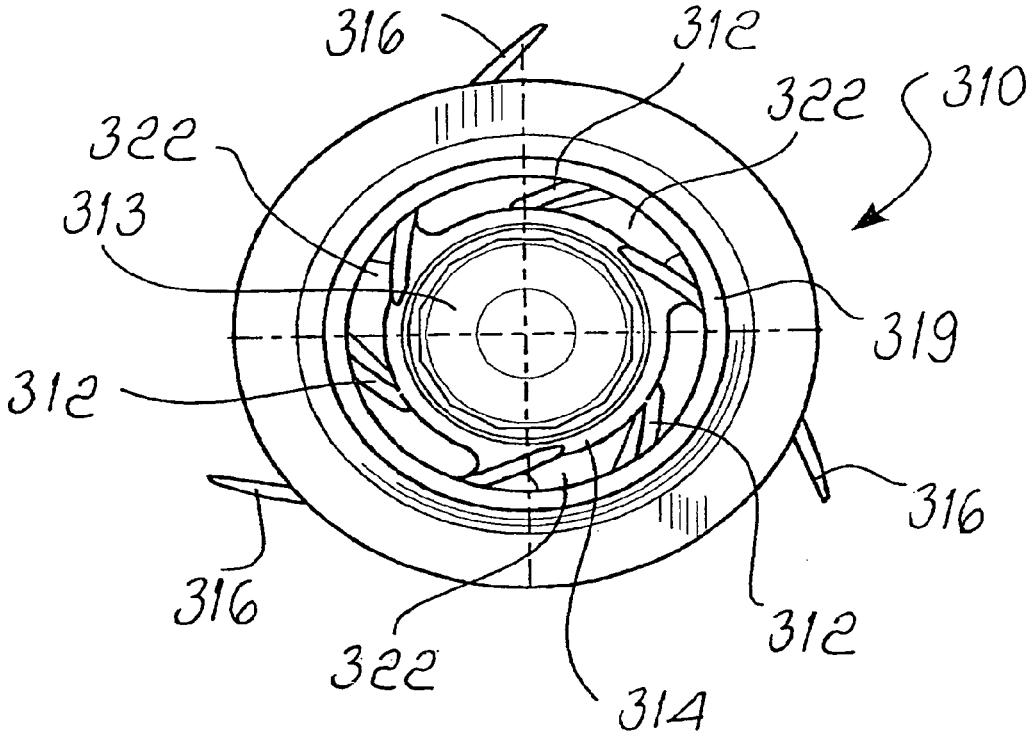
FIG. 9 is a front view of the impeller of FIG. 8.
Figure 10:
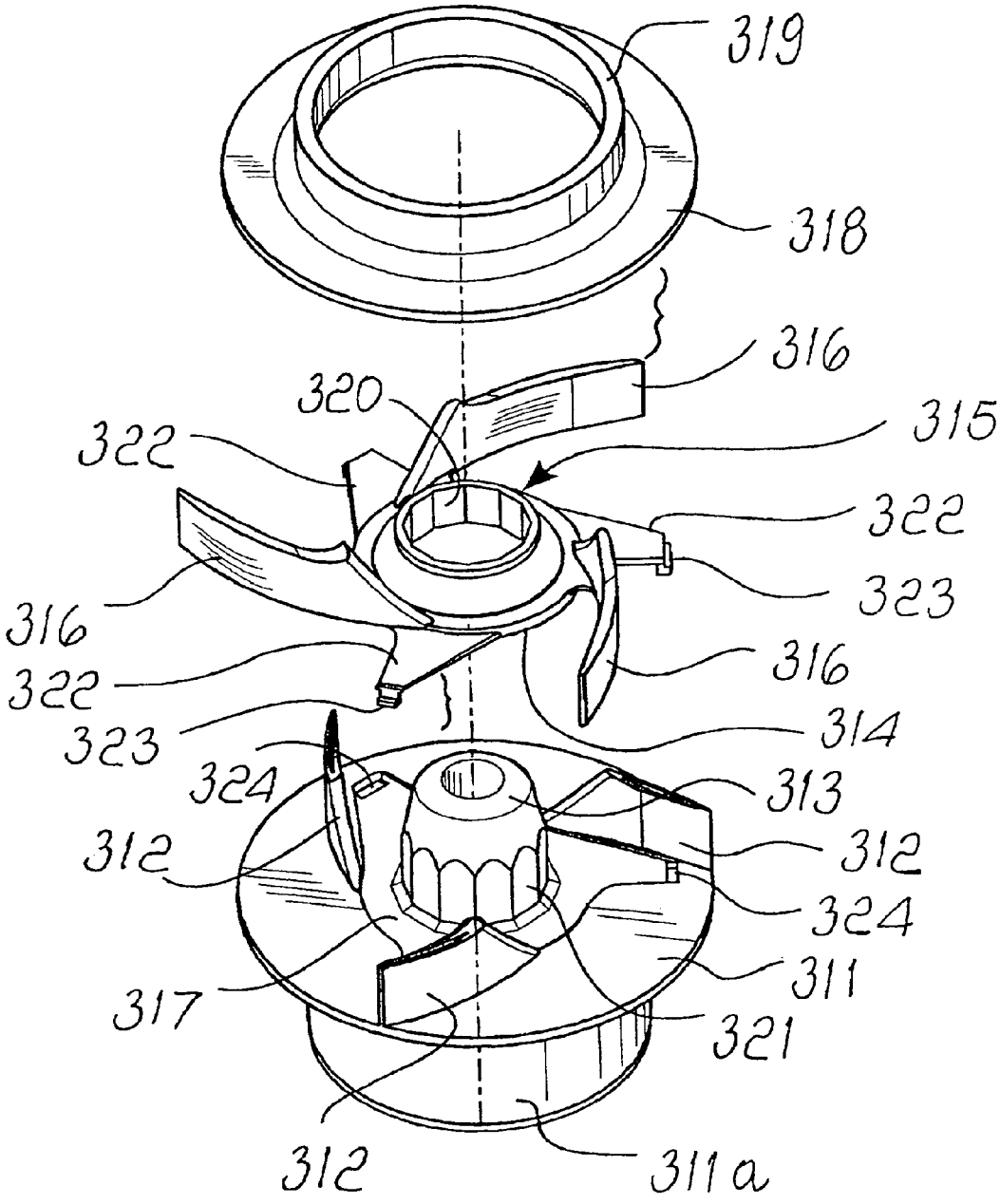
FIG. 10 is an exploded perspective view of the impeller of FIG. 8.

FIGS. 8 to 10 illustrate another possible configuration of the impeller.

In this case, the impeller according to the invention, which is entirely made of plastics, is generally designated by the reference numeral 310 and comprises a first disk-like element 311 (which is monolithic with respect to a bush 311*a*) which monolithically supports, in this case, three curved nondeformable vanes 312 which are angularly equidistant and, at the center, a rounded shank (which is separated from their inlet region).

The impeller 310 further comprises an annular element 314, whose dimensions are contained within the inlet dimensions of said nondeformable vanes 312; said annular element has means 315 (described in greater detail hereinafter) for coupling to said first disk-like element 311.

The annular element 314 supports, so that they cantilever outward in this case, three curved flexibly deformable vanes 316 which are angularly equidistant and are to be arranged alternately with the nondeformable vanes 312.

The annular element 14 is in fact accommodated in a complimentarily shaped seat 317 of the first disk-like element 311.

The flexibly deformable vanes 316 end externally with respect to the dimensions of the nondeformable vanes 312, with respect to which they have slightly smaller axial dimensions.

The flexibly deformable vanes 316 are adapted to modify, when loaded, their curvature in one direction of rotation so that the power required for rotation in that direction is higher than the maximum power that the motor (not shown for the sake of simplicity) can deliver.

The impeller 310 further comprises a second disk-like element 318, which encloses, together with said first disk-like element 311, the set of vanes 312 and 316 and is rigidly coupled, by ultrasonic welding, adhesive bonding or other known methods, to the nondeformable vanes 312, leaving free the flexibly deformable vanes 316, which have slightly smaller axial dimensions.

The second disk-like element 318 has a central hole and its edge 319 protrudes axially so as to form the inlet region for the fluid to be pumped.

As regards the coupling means 315, they comprise a shaped portion 320 which is for example polygonal (dodecagonal in the figures), is provided on the internal surface of the annular element 314, and mates with a complimentarily shaped surface 321 of the seat 317.

The coupling means 315 comprise a specific number of tabs 322 which are substantially radial, are angularly equidistant, protrude from the annular element 314, are inserted between the vanes 316 and end with respective axially elongated hooks 323, which engage by snap action, after elastic deformation, the first disk-like element 311 by insertion in suitable through holes 324 thereof.

The seat 317 of course has a shape which also accommodates the tabs 322.

The hooks 323 inserted in the through holes 324 prevent any axial movement of the assembly constituted by the disk 314 and the vanes 316.

The coupling means 315 determine the exact mutual positioning of the vanes 312 and 316.

The peripheral part of the vanes 316 can thus perform flexing movements which arise from the elastic characteristics of the plastic material of which they are made.

The deformation is greater for the wrong direction of rotation, and the vanes 316 modify their curvature so that in practice they block the rotation.

The flexibility of the material would of course also allow flexing in the correct direction of rotation, but the curvature of the vanes 316, which matches the fluid threads that form during the rotation of the impeller 310, causes the deformation in the correct direction of rotation to be very small in practice.

In practice it has been observed that the intended aim and objects of the present invention have been achieved.

With the flexible-vane impeller, monodirectionality is in fact ensured for all flow-rates/heads.

This is achieved in a constructively simple manner and has no effect on noise levels.

The invention thus conceived is susceptible of numerous modifications and variations, all of which are within the scope of the inventive concept.

Thus, for example, the change in the curvature of the vanes can be provided by means of a hinge, even of the film type, which connects each peripheral part to the central one.

In the embodiment of FIGS. 8, 9 and 10, even if the flexible vanes yield due to wear, the nondeformable vanes continue to give their constant contribution to the pumping action.

All the details may further be replaced with other technically equivalent elements.

In practice, the materials employed, so long as they are compatible with the contingent use, as well as the dimensions, may be any according to requirements.

The disclosures in Italian patent applications Nos. PD2000A000176 and PD2001A000110, from which this application claims priority, are incorporated herein as reference.

What is claimed is:

1. A monodirectional impeller for centrifugal electric pumps having a permanent-magnet synchronous motor, comprising:

a ring; and a plurality of vanes which protrude outwardly from said ring, defining a central region of the vanes adjacent to an axis of rotation of the ring, and a peripheral region of the vanes, the vanes being rigidly coupled to the ring at the central region of the vanes, wherein said vanes are nondeformable in their central region and are elastically deformable in their peripheral region, and wherein a curvature of said peripheral region is greater during rotation of the impeller, when loaded, in a wrong direction of rotation, so that the power required for rotation of the impeller in that direction is greater than the maximum power that can be delivered by the motor.

2. The impeller according to claim 1, wherein said ring is plastic and is accommodated in a corresponding seat of a disk which ends perimetrically on the outside of each one of said vanes.

3. The impeller according to claim 2, wherein said plurality of vanes have a curved profile and protrude monolithically from said disk, the peripheral regions of said vanes being separated from said disk and being flexibly deformable.

4. The impeller according to claim 2, comprising retention teeth which are alternated with said vanes and act as retention elements to avoid excessive curvatures of said peripheral region of vanes in a wrong direction of rotation.

5. The impeller according to claim 4, wherein in order to center said vanes with respect to said retention teeth, said ring has axial teeth to be inserted in suitable holes of said disk.

6. The impeller according to claim 1, wherein said vanes are enclosed between two disk-like elements.

7. The impeller according to claim 2, wherein said vanes are rigidly coupled to said disk or ring by interlocking and/or interference, ultrasonic welding, adhesive bonding, or equivalent methods.

8. The impeller according to claim 1, comprising:

a driving device which is constituted by a substantially cylindrical closed enclosure which is rigidly coupled to said impeller; and a tooth which protrudes from an inner wall of the driving device, said tooth being rigidly coupled to the impeller assembly and interacting with a tooth which protrudes from a ring which is rotatable about a shank which is rigidly coupled to a rotor shaft, a tooth protruding radially from said shank and interacting, in its rotation, with the tooth protruding from the ring, wherein the axial protrusion of the tooth protruding from the ring is such as to affect the path of the rotation of both teeth, said teeth being arranged axially so as to not interfere with each other.

9. The impeller according to claim 8, wherein said enclosure is constituted by a hollow body and by a cover which is closed hermetically.

10. The impeller according to claim 9, wherein an hermetic seal of said driving device is ensured by a gasket for said shaft and by the closure of said cover by ultrasonic welding, adhesive bonding, a gasket or equivalent methods.

11. The impeller according to claim 9, wherein grease having a shock absorbing function is arranged inside said hollow body.

12. The impeller according to claim 1, wherein the impeller comprises, at an end thereof, a seat for a first shim ring made of a hard material, a second shim ring made of a hard material being accommodated in a seat which is provided at one end on a cylindrical support which is supported by a bush which is rigidly coupled, by means of connecting spokes, to a ring which is accommodated in a corresponding seat of a volute of the impeller.

13. The impeller according to claim 12, wherein said support is monolithic with said bush.

* * * * *